United States Patent [19]

Liston et al.

[11] 4,331,222

[45] May 25, 1982

[54] METHOD FOR REDUCING BRAKE NOISE IN OIL-IMMERSED DISC BRAKES

[75] Inventors: Thomas V. Liston; Timothy R. Erdman, both of San Rafael, Calif.

[73] Assignee: Chevron Research Company, San Francisco, Calif.

[21] Appl. No.: 166,007

[22] Filed: Jul. 7, 1980

[51] Int. Cl.[3] ..... F16D 65/02; C10M 1/20

[52] U.S. Cl. ..... 188/264 B; 252/52 R

[58] Field of Search ..... 188/71.6, 73.5, 264 B, 188/264 E; 252/11, 33.6, 52 R, 56 R, 49.3, 79

[56] References Cited

U.S. PATENT DOCUMENTS

| | | | |
|---|---|---|---|
| 2,204,601 | 6/1940 | Kavanagh et al. | 252/56 R |
| 3,156,653 | 11/1964 | Foehr | 252/33.6 X |
| 3,366,211 | 1/1968 | May | 188/264 B X |
| 3,649,538 | 3/1972 | Hotten | 252/49.3 |
| 3,684,061 | 8/1972 | Ogawa et al. | 188/264 B X |
| 4,273,891 | 6/1981 | Pindar et al. | 252/52 R X |

*Primary Examiner*—Duane A. Reger

*Attorney, Agent, or Firm*—D. A. Newell; V. J. Cavalieri

[57] ABSTRACT

Lubricating oils containing oil soluble $C_8$–$C_{28}$ alkane-1,2-diols have been found to reduce brake noise for oil-immersed disc brakes.

4 Claims, No Drawings

METHOD FOR REDUCING BRAKE NOISE IN OIL-IMMERSED DISC BRAKES

BACKGROUND OF THE INVENTION

1. Field of the Invention

This invention relates to lubricating oil compositions, particularly to lubricating oil compositions useful as functional fluids in systems requiring coupling, hydraulic fluids and/or lubrication of relatively moving parts. More particularly, it is concerned with functional fluids for use in the lubrication of heavy machinery, particularly high-power-output tractors, and to the reduction of brake chatter therein.

2. Description of the Prior Art

The use of heavy machinery, such as a tractor, has increased the demand for high-performance lubricating compositions. Modern tractors have many power-assisted components, such as power steering and power brakes. Power brakes are preferably of the disc type since they have greater braking capacity. The preferred disc brakes are the wet-type brake, which are immersed in a lubricant and are therefore isolated from dirt and grime.

Such brakes suffer from at least one problem, namely, brake chatter or brake squawk. This phenomenon is a very unpleasant noise that occurs upon application of the brake. In the past, friction-modifying agents, such as dioleylhydrogen phosphite, have been added to the brake lubricating composition to reduce the chatter. Lubricating compositions containing this additive tend to suffer from very high wear rates, particularly at high temperature.

A further complication in eliminating brake chatter is the desire to use the same functional fluid, not only for the brake lubrication, but also for lubrication of other tractor parts, such as the hydraulic and mechanical power take-offs, the tractor transmission, gears and bearings, and the like. The functional fluid must act as a lubricant, a power transfer means, and as a heat transfer medium. Obtaining a compounded fluid to meet all of these needs without brake chatter is difficult.

U.S. Pat. No. 3,649,538 discloses and claims a process for lubricating aluminum in an aluminum-shaping operation with a lubricant comprising a mineral oil and 0.1 to 30 volume % of a $C_{10}$–$C_{30}$ 1,2-diol.

SUMMARY OF THE INVENTION

It has now been found that certain oil soluble alkane diols act as appropriate friction-modifying agents, which when added to a lubricating oil, exhibit good anti-chatter characteristics.

Thus, this invention relates to a method for reducing brake chatter between oil-immersed disc brakes by lubricating the contacting surfaces of said brakes with a composition comprising a major amount of a lubricating oil containing an effective amount to reduce chatter of an alkane-1,2-diol of the formula:

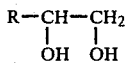

I wherein R is alkyl containing from 8 to 28 carbon atoms and mixtures thereof.

DETAILED DESCRIPTION

The alkane-1,2-diols of the Formula I useful in the present invention are those having from 8 to 28, preferably 15 to 20, carbon atoms. Single carbon number species may be employed such as octadecane-1,2-diol, eicosane-1,2-diol, and the like, but a blend of several carbon numbers is preferred. Typical blends include the 1,2-diols of 10 to 28 (incl.) carbon atom alkanes; the 1,2-diols of 12, 14, 16, 18 and 20 carbon atom alkanes; the 1,2-diols of 15 to 20 (incl.) carbon atom alkanes; the 1,2-diols of 15 to 18 (incl.) carbon atom alkanes; the 1,2-diols of 20 to 24 (incl.) carbon atom alkanes; the 1,2-diols of 24, 26 and 28 carbon atom alkanes, and the like.

The diols useful for this invention are either commercially available or are readily prepared from the corresponding 1-olefin by methods well known in the art. For example, the olefin is first reacted with peroxide, such as benzoyl peroxide or peroxyacetic acid to form an alkane-1,2-epoxide which is readily hydrolyzed under acid or base catalysis to the alkane-1,2-diol. In another process, the olefin is first halogenated to a 1,2-dihaloalkane and subsequently hydrolyzed to an alkane-1,2-diol by reaction first with sodium acetate and then with sodium hydroxide.

1-Olefins are available from the thermal cracking of waxes. This process produces olefins of all carbon numbers. 1-Olefins having an even number of carbon atoms are prepared by the well-known ethylene "growth" reaction. Olefins obtained by either of these processes are essentially linear in structure with little or no branching. Linear olefins are the preferred olefins for conversion into alkane-1,2-diols.

The lubricating oils used in the process of this invention contain a major amount of a lubricating oil and from about 0.2% to 5.0% by weight of alkane diol of Formula I, preferably from 0.5% to 4.0%, and most preferably 1% to 2% by weight based on the weight of the total composition. The optimum amount of alkane diol within these ranges will vary slightly depending on the base oil and other additives present in the oil.

Additive concentrates are also included within the scope of this invention. In the concentrate additive form, the diol is present in a concentration ranging from 5% to 50% by weight.

The lubricating compositions are prepared by admixing, using conventional techniques, the appropriate amount of the desired alkane-1,2-diol with the lubricating oil. When concentrates are being prepared, the amount of hydrocarbon oil is limited, but is sufficient to dissolve the required amount of alkane-1,2-diol. Generally, the concentrate will have sufficient diol to permit subsequent dilution with 1 to 10 fold more lubricating oil.

The hydrocarbon-based lubricating oil which may be employed in the practice of this invention includes a wide variety of hydrocarbon oils derived from synthetic or natural sources, such as naphthenic base, paraffin base, and mixed base oils as are obtained from the refining of crude oil. Other hydrocarbon oils derived from shale oil, tar sands or coal are also useful. The lubricating oils may be used individually or in combinations wherever miscible. The lubricating oils generally have a viscosity which ranges from 50 to 5,000 SUS (Saybolt Universal Seconds), and usually from 100 to 1,500 SUS at 100° F. The preferred oils have an SAE rating in the range of 10 to 40 and are paraffinic in structure.

In some tractor systems in which the brake fluid is kept in a separate sump, the hydrocarbon oil/alkane-1,2-diol composition of this invention is a sufficient lubricant and can be used as such. However, in the more usual tractor systems in which there is a common sump for all functional fluids, e.g., transmission lubricant, hydraulic fluid, and the like, the lubricating oil is compounded with a variety of additives. These additives include anti-oxidants, dispersants, rust inhibitors, foam inhibitors, corrosion inhibitors, anti-wear agents, viscosity index (VI) improvers, friction control agents, elastomer swell agents, extreme pressure (EP) agents, pour point depressants, and metal deactivators. All of these additives are well known in the lubricating oil art.

The preferred additives are dispersants, such as the alkenyl succinimides, in particular, the polyisobutenyl succinimide of a polyethylene polyamine, e.g., tetraethylene pentamine or triethylene tetramine. Such dispersants may be present in the finished product at concentrations in the range of 0.5% to 12%, preferably 2% to 5%.

Another class of preferred additives are the hydrocarbon soluble detergents, such as the alkylphenates, the alkylbenzene sulfonates or the alkane sulfonates. These detergents are preferably present as the calcium salt in quantities ranging from 10 to 60, preferably 20 to 50, millimoles of alkyl phenol per kilogram and from 5 to 25, preferably 10 to 20, millimoles of sulfonate per kilogram of finished product. Overbased phenates and sulfonates may also be employed to prevent acid build up. Such materials contain excess calcium, generally as calcium carbonate, over that necessary to neutralize the hydrocarbon phenols or sulfonic acid detergents. These overbased phenates and sulfonates are generally present in the finished composition in amounts of 50 to 200, preferably 75 to 150, millimoles per kilogram of product.

Furthermore, the finished lubricant preferably contains extreme pressure additives, such as the alkyl or aryl zinc dithiophosphates. Preferably, the alkyl type are employed wherein the alkyl group has from 6 to 12 carbon atoms. The total amount of the zinc dialkyldithiophosphate present is in the range of 3 to 30, preferably 15 to 25, millimoles of zinc per kilogram of finished product.

Concentrates containing the above-described additives would have a correspondingly higher concentration of the additive such that upon dilution, the final concentrations would be within the above ranges.

The compositions of this invention were tested in the laboratory and in the field on a tractor. The laboratory test was carried out on an SAE No. 2 friction machine modified by replacing the high-speed electric motor with a moderate-speed hydraulic motor. The test specimen as a sandwich of one General Metals Powder Co. sintered bronze plate between two steel spacer plates mounted in the above apparatus. The test fluid, about 300 grams in quantity, when then charged to the test-oil sump. The test plates were turned at 50 RPM. A piston-like brake was applied at an applied pressure of 40 pounds; (subsequently, the test was repeated with an applied brake pressure of 75 pounds). The strain gauge of the SAE No. 2 apparatus measured the torque as a deflection of a pointer. High-brake chatter compositions gave a series of wide deflections, whereas compositions of low-brake chatter gave essentially no deflection to the pointer. Satisfactory compositions are those giving less than 5 mm of deflection.

EXAMPLE 1

The above described test was run on a noncompounded midcontinent paraffin based mineral oil (Citcon 350 N). The deflection was 36 mm, indicating a very high-brake chatter lubricant. Then sufficient alkane-1,2-diol to give a concentration of 1.5% by weight and comprising about equal weights of pentadecane-1,2-diol, hexadecane-1,2-diol, heptadecane-1,2-diol and octadecane-1,2-diol was added to this base oil. The resulting composition gave a 2 mm deflection to the torque gauge of the above apparatus, indicating no noticeable brake chatter.

EXAMPLE 2

A hydrocarbon oil composed of 75 parts of the base stock of Example 1 and 25 parts of a similar but lower viscosity oil (Citcon 200 N) was compounded with about 4% of a conventional lubricating oil additive package containing dispersants, detergents, zinc EP agents, and hydroxyesters. This compounded oil was then tested in the modified SAE No. 2 apparatus. The results are given in Table I. Then various blends of alkane-1,2-diols were added to the compounded oil in the indicated quantities (Table I) and these were also tested in the same apparatus. The results are given in Table I.

TABLE I

Effect of Alkane-1,2-diols Upon Laboratory Brake Chatter Simulation

| Run No. | Alkane-1,2-diol, | % | Maximum Deflection, mm[1] At 40 Pounds | At 75 Pounds |
|---|---|---|---|---|
| 1 | None[6] | — | 11[2], 8[2] | 12[2], 11[3] |
| 2 | Tetradecane-1,2-diol, | 1.0 | 7[4] | 6[3] |
| 3 | Tetradecane-1,2-diol, | 2.0 | 4[5] | 4[2] |
| 4 | Mixture of $C_{11}$–$C_{14}$ (inc.)-1,2-diols, | 1.0 | 8[3] | 8[6] |
| 5 | Mixture of $C_{11}$–$C_{14}$ (inc.)-1,2-diols, | 2.0 | 2[3], 3[2] | 4[2], 5[5] |
| 6 | Mixture of $C_{15}$–$C_{18}$ (inc.)-1,2-diols, | 1.0 | 5[2] | 3[3] |
| 7 | Mixture of $C_{15}$–$C_{18}$ (inc.)-1,2-diols, | 2.0 | 2[2], 3[5] | 4[2], 3[5] |

Footnotes

[1]Deflection measurements were made several times at both 40 pounds and 75 pounds of applied pressure. In some cases, a second series of trials was made at a later date.

[2]Average of 4 trials.

[3]Average of 5 trials.

[4]Average of 6 trials.

[5]Average of 3 trials.

[6]3.7% of a 44% in oil solution of polyisobutenyl succinimide; 12.5 m moles/kg of a mixture of calcium alkane sulfonates and calcium alkylbenzene sulfonates; 37 m moles/kg overbased calcium sulfonate; 45 m moles/kg of carbonated, sulfurized calcium alkylphenate; 16.5 m moles/kg of a mixed zinc dialkyl dithiophosphate; 6 m moles/kg zinc bis (dialkylphenyl) dithiophosphate; 0.2% of a 50% solution of zinc dialkyl dithiocarbamate in oil; 0.025% of a polyglycol-sulfonic acid reaction product; 0.2% of pentaerythritol monooleate.

The above results, in conjunction with Example I, show that the presence of alkane-1,2-diols of the Formula I or mixtures thereof in the brake lubricant greatly decrease the brake chatter. Furthermore, these experiments show that the presence of other additives in the fluid affect the ultimate level of brake chatter. But in all cases, the alkane-1,2-diols do suppress the level of brake chatter.

EXAMPLE 3

In the field, a Ford tractor, Model 6600, having medium-to-heavy brake chatter (101–102 decibels), with a regular commercial compounded oil was used to test formulations containing alkane-1,2-diols of the Formula I. For these tests a base lubricating oil was compounded with the usual succinimide dispersants, sulfonate detergents, and zinc dialkyldithiophosphate EP agents. Then after testing this compounded base lubricant in the tractor, various quantities of a mixture of $C_{15}$–$C_{18}$ (incl.) alkane-1,2-diols were added to the lubricant and the test repeated. The test comprised driving the tractor in high range fifth gear at 2000 engine RPM with alternating left and right brake applications while turning sharply. The noise level was determined by ear as none, light, medium or heavy. The results are shown in Table II.

TABLE II

Effect of Alkane-1,2-diols on Tractor Brake Chatter

| Run No. | Percent Alkane-1,2-diol | SOUND LEVEL (CHATTER) LEFT | RIGHT |
|---|---|---|---|
| 1 | —(1) | Med-Hvy | Med-Hvy |
| 2 | 1.0 | Lt. Intermittent | None |
| 3 | —(2) | Lt. Intermittent | Med-Hvy |
| 4 | 0.5 | Lt., None | Lt., None |

TABLE II-continued

Effect of Alkane-1,2-diols on Tractor Brake Chatter

| Run No. | Percent Alkane-1,2-diol | SOUND LEVEL (CHATTER) LEFT | RIGHT |
|---|---|---|---|
| 5 | 1.0 | None | None |

(1)Base lubricant was a mixture of 65/35% (wt.) of a paraffinic base oil of 160 N and 300 N, respectively.
(2)Base lubricant is a mixture of 30% (wt.) of 160 N, 58% (wt.) of 300 N, and 12% (wt.) of 100 pale oil, a naphthenic base.

These results show a dramatic improvement in tractor brake chatter obtained by the use of alkane-1,2-diols in the brake lubricant which also contained a conventional additives package.

What is claimed is:

1. A method for reducing oil-immersed disc brake chatter by lubricating the contacting surfaces of oil-immersed disc brakes with a composition comprising a major amount of a lubricant containing an effective amount to reduce chatter of an alkane-1,2-diol of the formula:

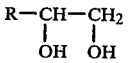

wherein R is alkyl containing from 8 to 28 carbon atoms or mixtures thereof.

2. The method of claim 1 comprising from about 0.2% to about 5% by weight of said diol.

3. The method of claim 1 wherein said R contains from 10 to 20 carbon atoms.

4. The method of claim 1 wherein said diol comprises a mixture of 1,2-diols containing from 15 to 18 carbon atoms.

* * * * *